US011759812B2

(12) United States Patent
Huang et al.

(10) Patent No.: US 11,759,812 B2
(45) Date of Patent: Sep. 19, 2023

(54) APPARATUS FOR MANUFACTURING GOLF BALLS EACH HAVING EXTERIOR PATTERN

(71) Applicant: FOREMOST GOLF MFG. LTD., Taipei (TW)

(72) Inventors: Chia-Sheng Huang, Taipei (TW); Chi-Ling Lin, Changhua County (TW); Chia-Cheng Wu, Changhua County (TW); Ching-Hsiang Liu, Yunlin County (TW)

(73) Assignee: FOREMOST GOLF MFG. LTD., Taipei (TW)

( * ) Notice: Subject to any disclaimer, the term of this patent is extended or adjusted under 35 U.S.C. 154(b) by 154 days.

(21) Appl. No.: 17/395,467

(22) Filed: Aug. 6, 2021

(65) Prior Publication Data

US 2022/0212219 A1 Jul. 7, 2022

(30) Foreign Application Priority Data

Jan. 4, 2021 (TW) ..... 110100150

(51) Int. Cl.

| | |
|---|---|
| ***B05B 13/02*** | (2006.01) |
| ***A63B 45/02*** | (2006.01) |
| ***B05B 15/68*** | (2018.01) |
| ***A63B 37/00*** | (2006.01) |

(52) U.S. Cl.

CPC ..... *B05B 13/0235* (2013.01); *A63B 45/02* (2013.01); *B05B 13/0228* (2013.01); *B05B 13/0278* (2013.01); *B05B 15/68* (2018.02); *A63B 37/0022* (2013.01)

(58) Field of Classification Search

None

See application file for complete search history.

(56) References Cited

U.S. PATENT DOCUMENTS

| | | | | |
|---|---|---|---|---|
| 3,513,808 | A * | 5/1970 | Peter | B05B 13/0442 118/314 |
| 6,319,563 | B1 * | 11/2001 | Skrabski | B05B 13/0442 427/407.1 |
| 9,789,364 | B2 | 10/2017 | Matsuyama | |
| 11,571,708 | B2 * | 2/2023 | Huang | B05B 13/0228 |
| 2010/0151971 | A1 * | 6/2010 | Mydlack | A63B 45/00 473/378 |
| 2010/0298069 | A1 * | 11/2010 | Goodwin | A63B 45/00 473/378 |

(Continued)

FOREIGN PATENT DOCUMENTS

| | | | |
|---|---|---|---|
| JP | 2002204840 | A | 7/2002 |
| TW | I445580 | B | 7/2014 |

*Primary Examiner* — Binu Thomas

(74) *Attorney, Agent, or Firm* — Li & Cai Intellectual Property Office

(57) ABSTRACT

An apparatus for manufacturing golf balls each having an exterior pattern includes a conveying device and a spraying device. The spraying device is disposed at one side of a first processing area. The conveying device is configured to convey a ball-shaped body into the first processing area along a predetermined path, and to rotate the ball-shaped body at a predetermined speed. The spraying device includes a first sprayer and a second sprayer. The first sprayer and the second sprayer are configured to apply a color paint to the ball-shaped body from each of an upper position and a lower position.

8 Claims, 13 Drawing Sheets

(56) References Cited

U.S. PATENT DOCUMENTS

| | | | | |
|---|---|---|---|---|
| 2012/0237689 | A1* | 9/2012 | Lin | B05B 13/0235 118/62 |
| 2012/0283043 | A1* | 11/2012 | Fitchett | A63B 45/00 473/378 |
| 2015/0273281 | A1* | 10/2015 | Ohno | B05B 13/0235 427/425 |
| 2022/0266293 | A1* | 8/2022 | Huang | B05D 7/57 |

* cited by examiner

APPARATUS FOR MANUFACTURING GOLF BALLS EACH HAVING EXTERIOR PATTERN

CROSS-REFERENCE TO RELATED PATENT APPLICATION

This application claims the benefit of priority to Taiwan Patent Application No. 110100150, filed on Jan. 4, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an apparatus for manufacturing golf balls, and more particularly to an apparatus for manufacturing golf balls each having an exterior pattern.

BACKGROUND OF THE DISCLOSURE

With the increase of living standards and the emphasis on outdoor recreational activities, more and more people have taken an interest in golf, including men and women from all walks of life or of all ages. That is to say, golf players of different industries or different ages of men or women can play together for competition and communication. This is the appeal of golf.

There are many types and brands of golf balls in the market. Thus, many companies use different colors, patterns or texts to mark golf balls so as to increase their identifiability, thereby attracting consumers' attention, but this has proved difficult to execute.

SUMMARY OF THE DISCLOSURE

In response to the above-referenced technical inadequacies, the present disclosure provides an apparatus for manufacturing golf balls each having an exterior pattern. Such never-before-seen golf balls can increase an aesthetics and ornamentality of the golf balls, which allows the golf balls to be more appealing.

In one aspect, the present disclosure provides an apparatus for manufacturing golf balls each having an exterior pattern, which includes a conveying device and a spraying device. The conveying device includes a first conveyor and a plurality of rotatable retainers disposed on the first conveyor. The first conveyor is configured to sequentially convey the rotatable retainers into a first processing area. Each of the rotatable retainers is configured to retain a ball-shaped body, and to rotate the ball-shaped body being in the first processing area at a predetermined speed. The spraying device is disposed at one side of the first processing area and includes a first sprayer and a second sprayer. The first sprayer and the second sprayer are configured to apply a color paint to the ball-shaped body being in the first processing area from each of an upper position and a lower position, respectively, so as to allow the ball-shaped body to have the exterior pattern.

One of the beneficial effects of the present disclosure is that, the apparatus for manufacturing golf balls each having an exterior pattern of the present disclosure can allow the golf balls to have an appealing appearance showing a unique visual effect during its service life, by virtue of "each of the rotatable retainers of the conveying device is configured to retain a ball-shaped body and rotate the ball-shaped body being in the first processing area at a predetermined speed, and the first sprayer and the second sprayer of the spraying device are configured to apply two color paints from an upper position and a lower position to the ball-shaped body being in the first processing area, respectively".

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
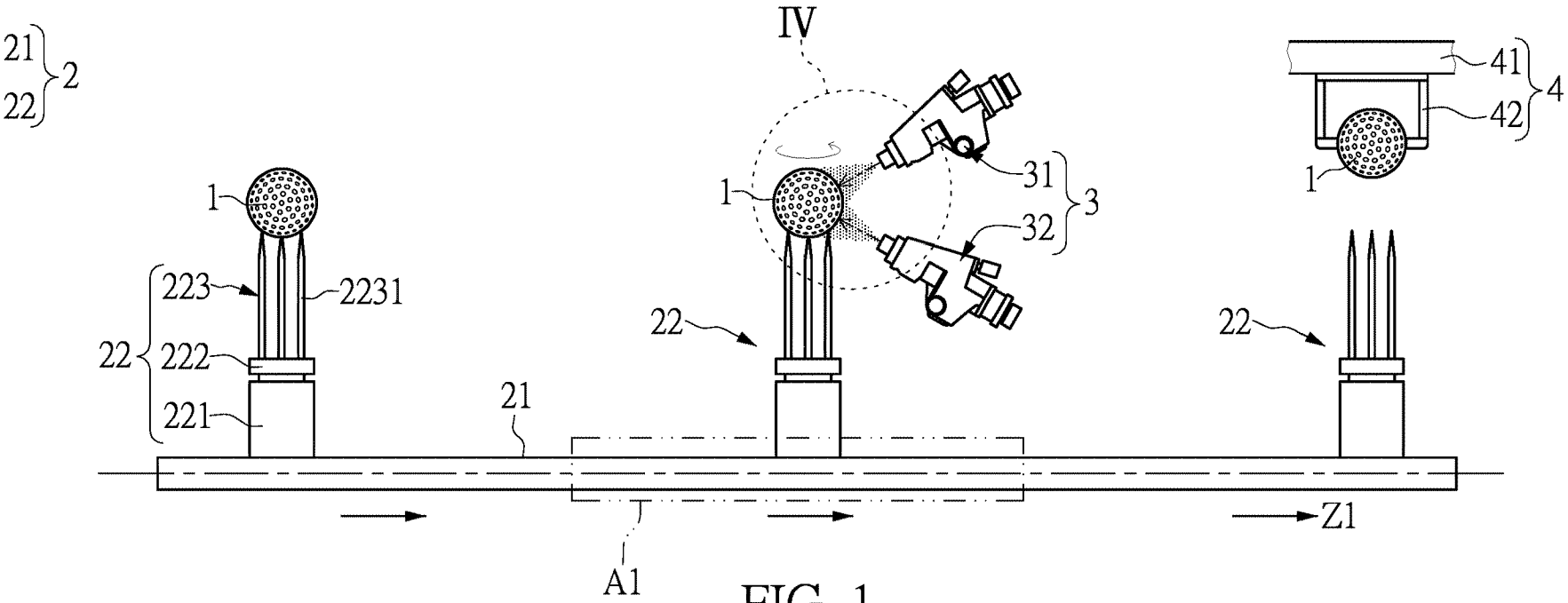
FIG. 1 is a planar view showing a manufacturing process of an apparatus for manufacturing golf balls each having an exterior pattern according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

With the popularization of golf in recent years, the sport has attracted more and more players. When using a golf ball that matches a personal preference, a user can engage in practice or competition with a higher level of enjoyment. Therefore, various manufacturers have designed golf balls with myriad appearances, thus inspiring the development of a method of manufacturing a golf ball as provided by the present disclosure

First Embodiment

Figure 3:
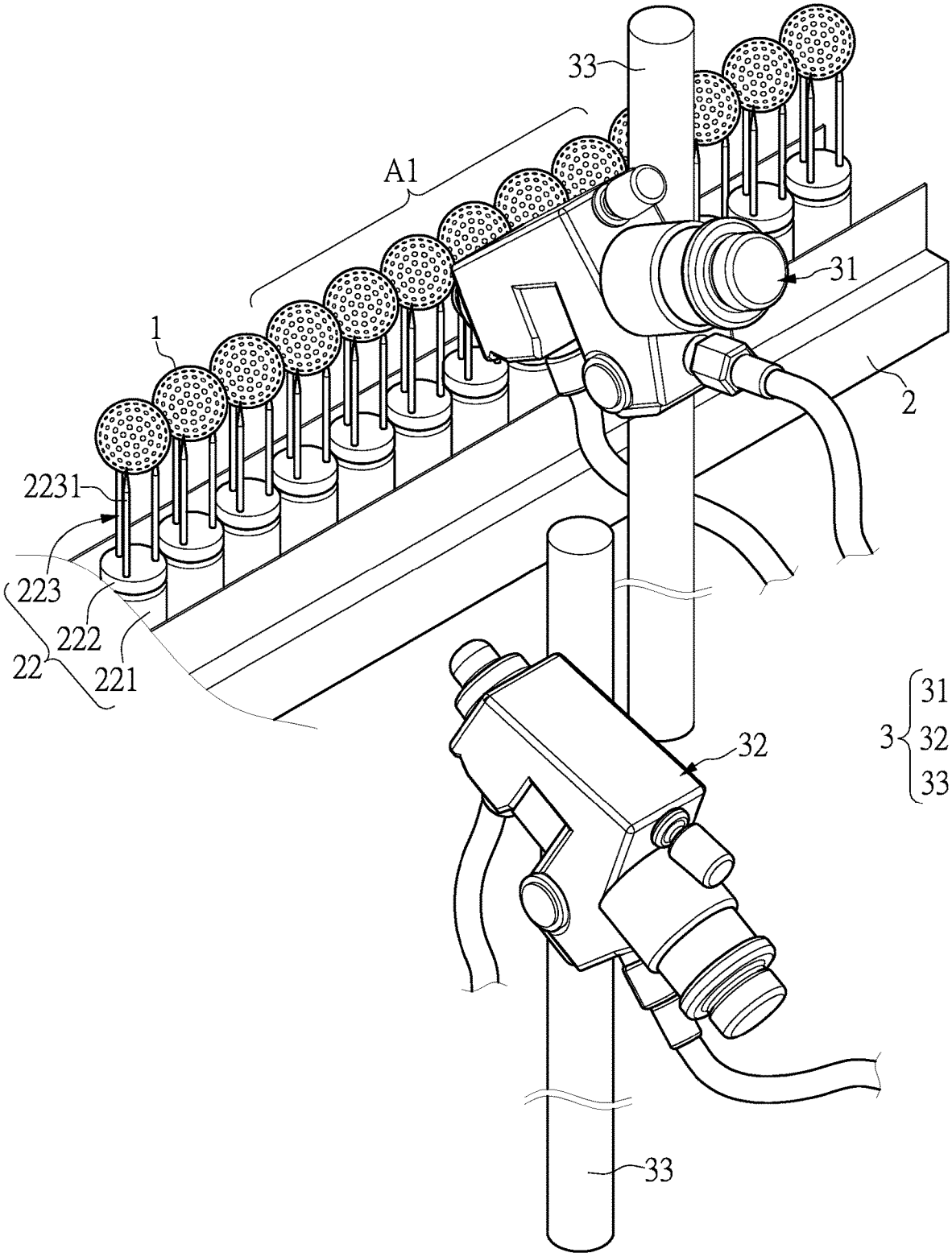
FIG. 3 is a partial perspective view of the apparatus according to the first embodiment of the present disclosure.
Figure 4:
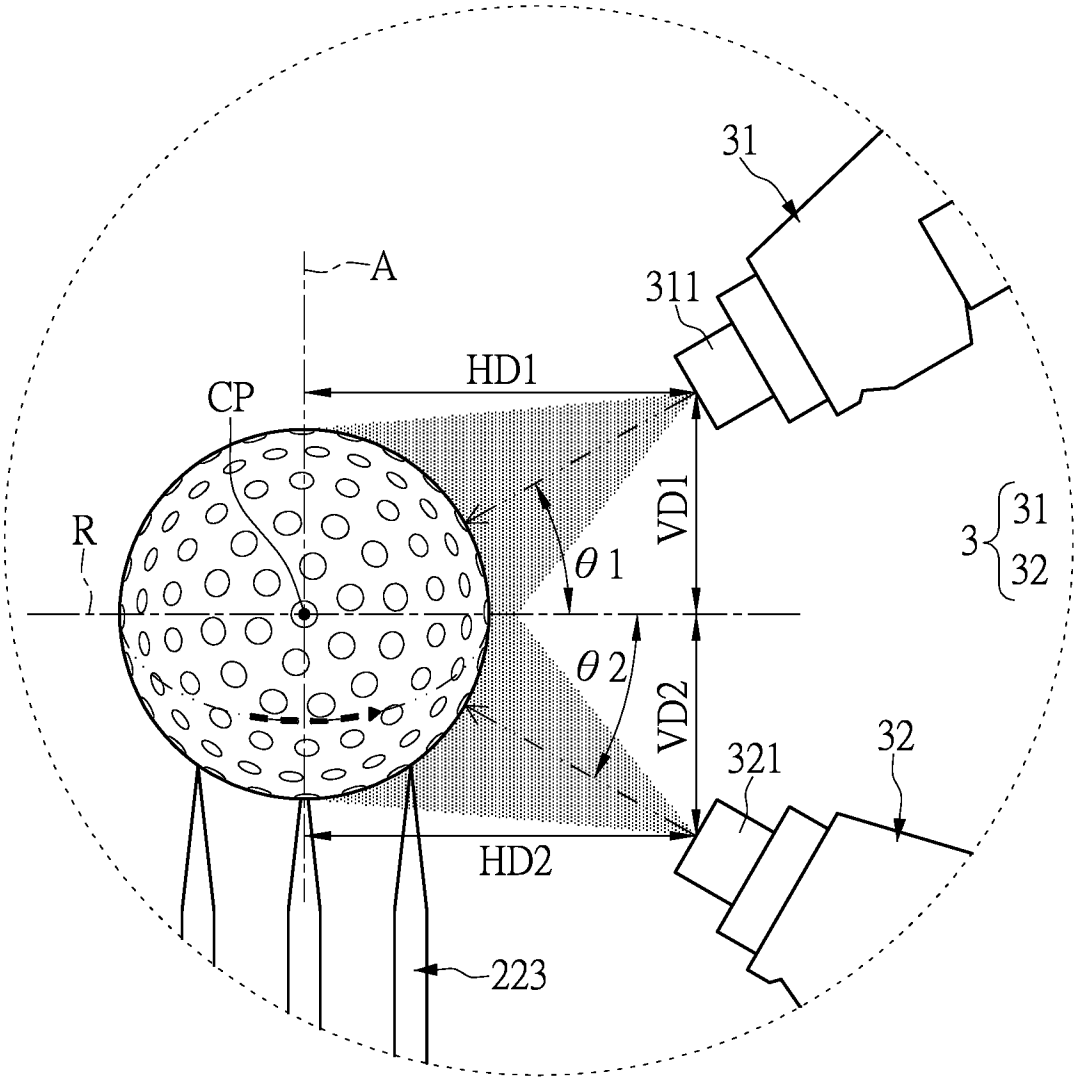
FIG. 4 is an enlarged view of part IV of FIG. 1.

Referring to FIG. 1, FIG. 3 and FIG. 4, a first embodiment of the present disclosure provides an apparatus for manufacturing golf balls each having an exterior pattern, which mainly includes a conveying device 2 and a spraying device 3. In use, the spraying device 3 can be disposed at one side of a first processing area A1, and the conveying device 2 can convey a plurality of ball-shaped bodies 1 into the first processing area A1. Accordingly, the spraying device 3 can apply at least one kind of color paint to the ball-shaped bodies 1 by spraying, so as to provide the exterior pattern to each of the ball-shaped bodies 1.

In the present embodiments, the conveying device 2 includes a first conveyor 21 and a plurality of rotatable retainers 22. The first conveyor 21 is arranged to be parallel to a ground plane, so as to convey the ball-shaped bodies 1 along a predetermined path Z1. The rotatable retainers 22 are movably disposed on the first conveyor 21. In such a structure, the first conveyor 21 is configured to sequentially convey the rotatable retainers 22 into the first processing area A1, and each of the rotatable retainers 22 is configured to retain one of the ball-shaped bodies 1, and to rotate the one of ball-shaped bodies being in the first processing area A1 at a predetermined speed.

In practice, the first conveyor 21 can be a belt conveyor. The rotatable retainer 22 can include a driving assembly 221, a supporting platform 222 and a first retaining member 223. The driving assembly 221 can be arranged to move on the first conveyor 21 and along the predetermined path Z1. The supporting platform 222 is disposed on the driving assembly 221 and arranged to be parallel to the first conveyor 21. The first retaining member 223 is disposed on the supporting platform 222, and it can include at least three pointed bodies 2231 extending from the supporting platform 222. The first retaining member 223 is configured to retain a ball-shaped body 1 at a predetermined height, such that the ball-shaped body 1 defines a rotation axis A and a horizontal reference plane R, as shown in FIG. 4. The rotation axis A passes through a center point CP of the ball-shaped body 1. The horizontal reference plane R is perpendicular to the rotation axis A, and passes through the center point CP of the ball-shaped body 1. The above description is only exemplary, and is not intended to limit the scope of the present disclosure.

Figure 7:
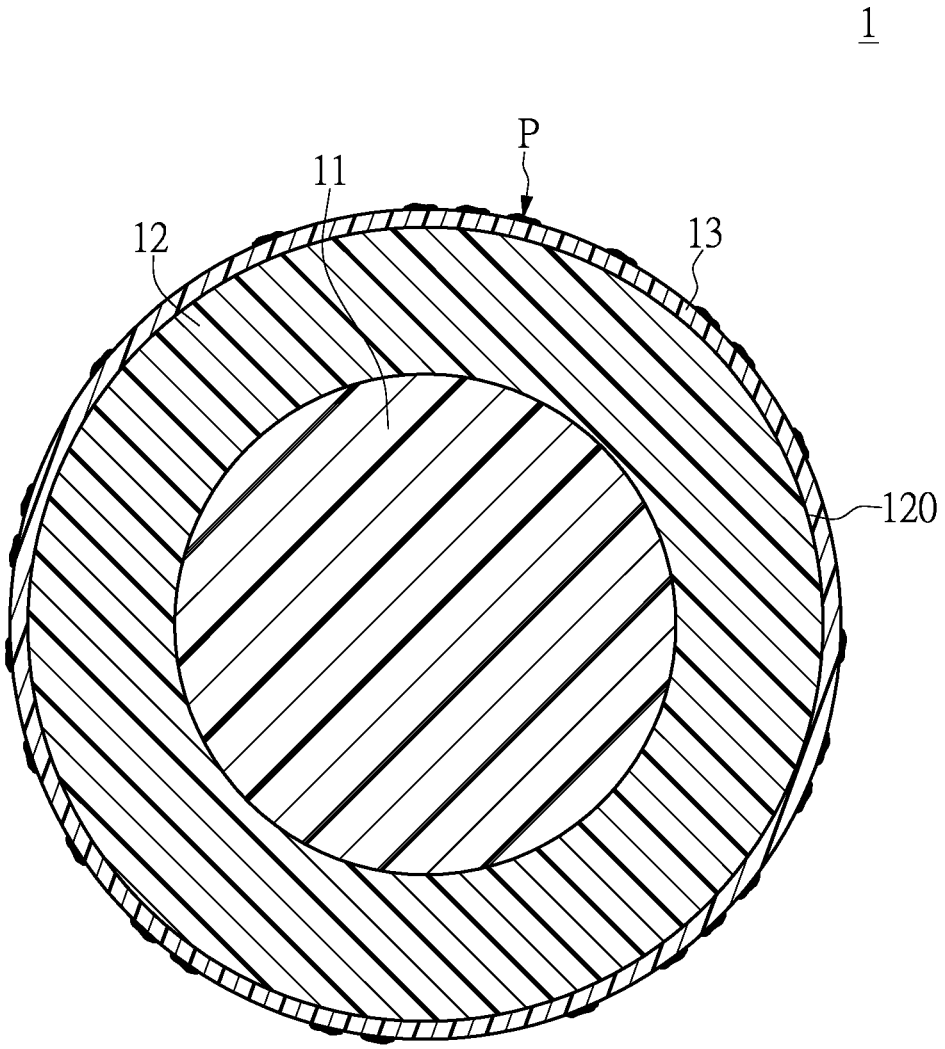
FIG. 7 is a schematic view showing a structure of the golf ball manufactured by the apparatus of the present disclosure.
Figure 9:
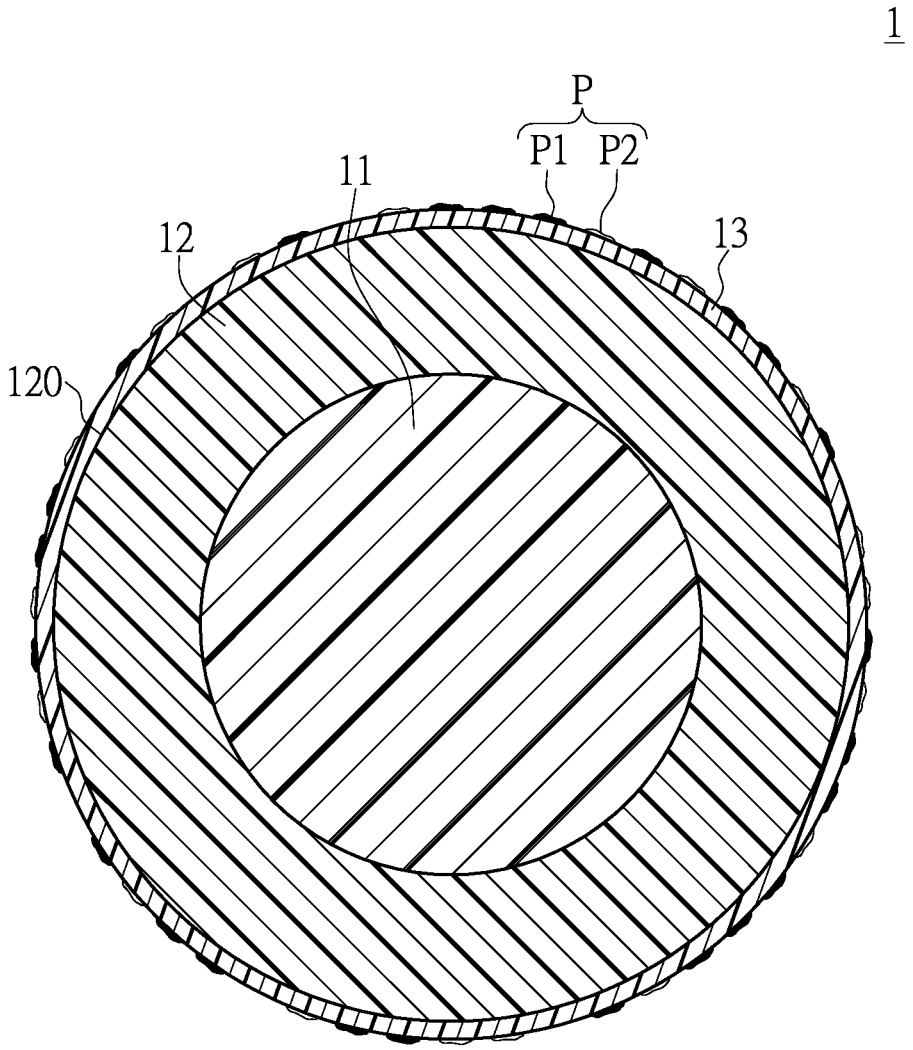
FIG. 9 is a schematic view showing another structure of the golf ball manufactured by the apparatus of the present disclosure.

Reference is made to FIG. 7 and FIG. 9. The ball-shaped body 1 can include a ball core 11, a ball shell 12 enclosing the ball core 11, and a base layer 13 coated an outer surface 120 of the ball shell 12, but it is not limited thereto. The base layer 13 uniformly and entirely covers the outer surface 120 of the ball shell 12. That is, a thickness of the base layer 13 on one point or area of the outer surface 120 is approximately the same as another thickness of the base layer 13 on another one point or area of the outer surface 120. The base layer 13 is mainly used to support and highlight an exterior pattern P, and in addition, it can be used to support an identification mark or sign (not shown).

In practice, the ball core 11 and the ball shell 12 can be formed from any suitable material. For example, the ball core 11 and the ball shell 12 are each a cured product of an ionomer, a polymer or a rubber component. Furthermore, the ball shell 12 can have a desired number of dimples 121 with a desired shape, so as to reduce a gas drag effect on the golf ball during flight, thereby increasing the flight distance of the golf ball. In certain embodiments, the number of the dimples can be from 200 to 500, and preferably from 250 to 400. The shape of the dimples can be round or polygonal. The base layer 13 can have one or more base color layers such as white color layers. The base layer 12 can also have one or more base color layers and one or more outer color layers. The base color layer(s) and the outer color layer(s) show different colors. The above description is only exemplary, and is not intended to limit the scope of the present disclosure.

Figure 6:
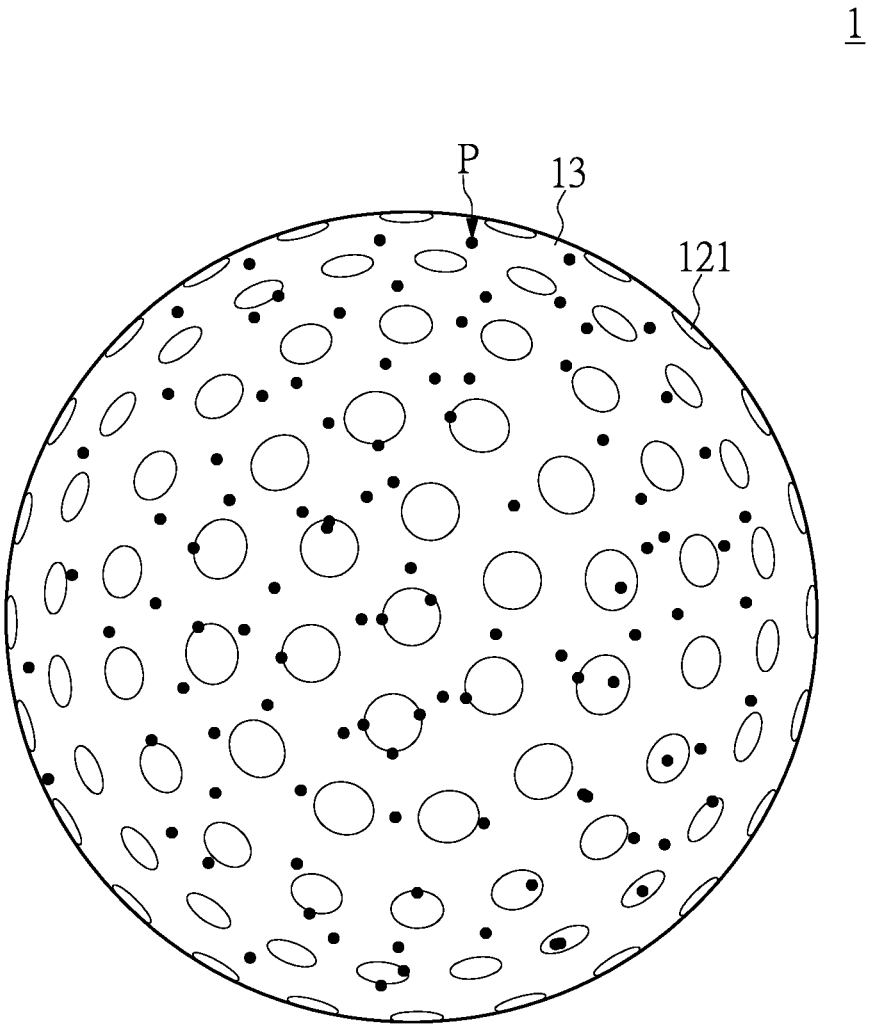
FIG. 6 is a schematic view showing an appearance of the golf ball manufactured by the apparatus of the present disclosure.
Figure 8:
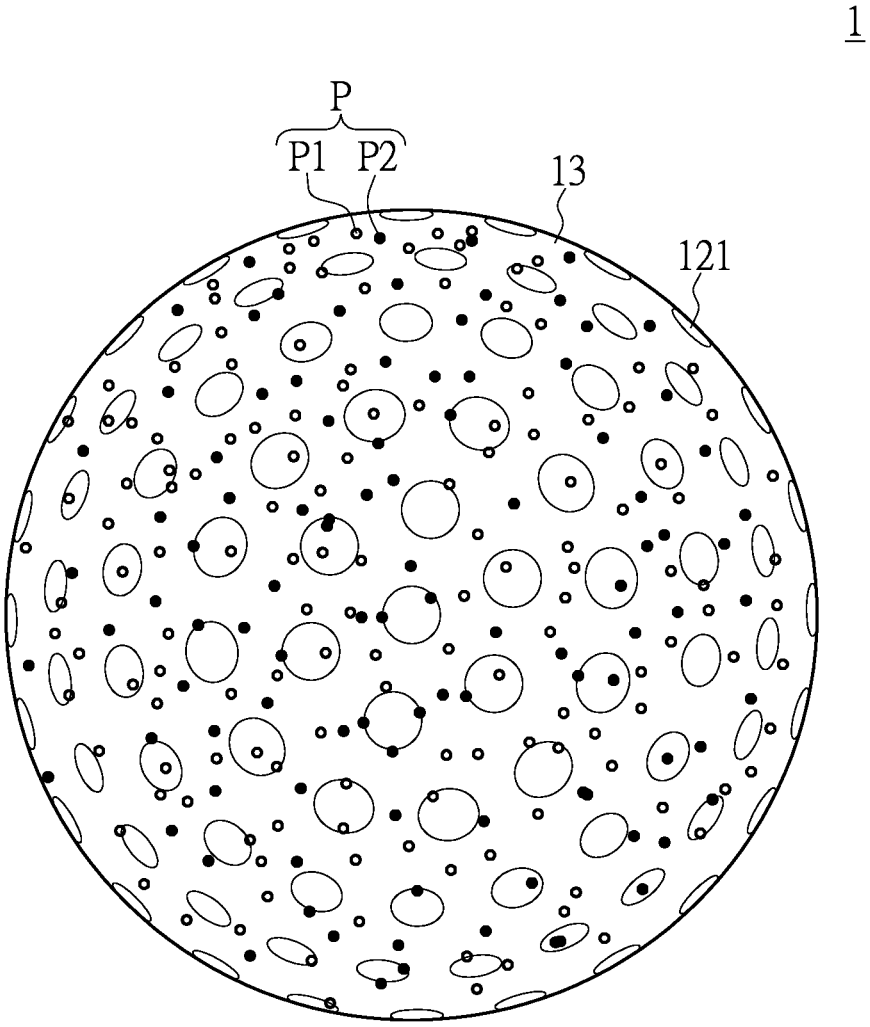
FIG. 8 is a schematic view showing another appearance of the golf ball manufactured by the apparatus of the present disclosure.
Figure 10:
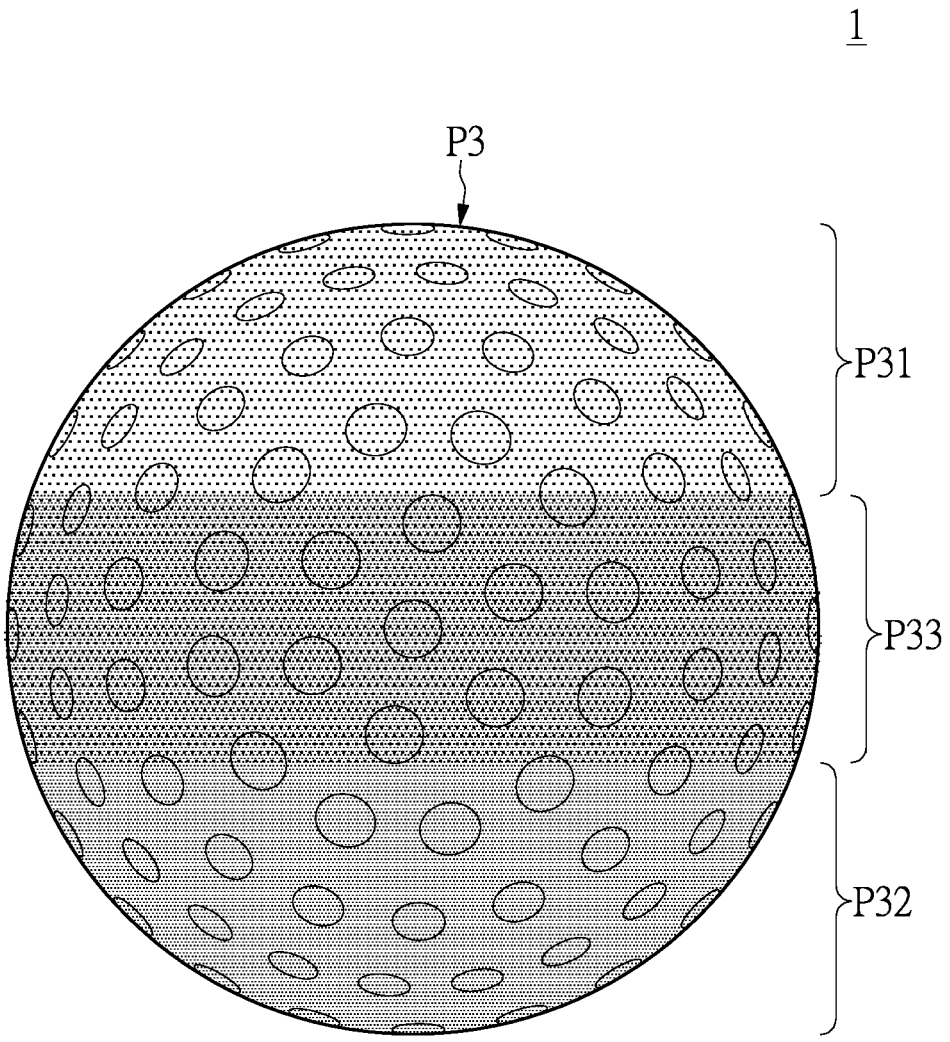
FIG. 10 is a schematic view showing still another appearance of the golf ball manufactured by the apparatus of the present disclosure.

Reference is made to FIG. 1, FIG. 3 and FIG. 4, which are to be read in conjunction with FIG. 6, FIG. 8 and FIG. 10. The spraying device 3 can include a first sprayer 31 and a second sprayer 32, which are configured to simultaneously apply one kind or two different kinds of color paint(s) from an upper position and a lower position to the ball-shaped bodies 1 being in the first processing area A1, respectively. Accordingly, an exterior pattern is formed on the base layer 13 of each of the ball-shaped bodies 1. The upper position is an upper diagonal position of the ball-shaped bodies 1, and the lower position is a lower diagonal position of the ball-shaped bodies 1. When applying the color paint(s), each of the ball-shaped bodies 1 can be driven by a corresponding rotatable retainer 22 to rotate around the rotation axis A, a rotation speed of which can be 300 rpm. In order to improve a uniformity and fineness of the exterior pattern, the first sprayer 31 and the second sprayer 32 can be symmetrically arranged at upper and lower sides of the horizontal reference plane R, in which each of the ball-shaped bodies 1 being in the first processing area A1 is divided into an upper half portion and a lower half portion by the horizontal reference plane R. Furthermore, the first sprayer 31 is inclined downward and the second sprayer 32 is inclined upward.

More specifically, when the first sprayer 31 and the second sprayer 32 apply one kind of color paint, the resulting exterior pattern can be a non-uniform dot pattern P having pattern dots of a single color, as shown in FIG. 6. Furthermore, when the first sprayer 31 and the second sprayer 32 sequentially apply two different kinds of color paints, the resulting exterior pattern can have a first non-uniform dot pattern P1 and a second non-uniform dot pattern P2, as shown in FIG. 8, i.e., pattern dots of two different colors are present in the resulting exterior pattern. The first non-uniform dot pattern P1 can be partially overlapped with the second non-uniform dot pattern P2. The two different colors can be selected from original colors such as black, red, blue, purple, orange, yellow and green, any light color thereof, and any mixed color thereof. In consideration of an effect of color matching or color contrast, the two different colors can respectively be an advancing color and a receding color.

In addition, when the first sprayer 31 and the second sprayer 32 respectively apply two different kinds of color paints, the resulting exterior pattern can be a multi-layered pattern P3, as shown in FIG. 10, which includes an upper-layered pattern area P31, a lower-layered pattern area P32 and a mid-layered pattern area P33 located between the upper-layered pattern area P31 and the lower-layered pattern area P32. The upper-layered pattern area P31 has a first color. The lower-layered pattern area P32 has a second color. The mid-layered pattern area P33 has a mixed color of the first color and the second color.

According to particular requirements, the ball-shaped body 1 can further include an outer cover layer (not shown) for covering the exterior pattern P. The outer cover layer can be formed in a continuous shape and over an outer surface of the base layer 13 entirely. The outer cover layer can include one or more transparent coated layers. Accordingly, a durability of the golf ball can be increased, and the exterior pattern P can remain intact and clear during a service life of the golf ball.

Reference is made to FIG. 3 and FIG. 4. The spraying device 3 can further a support 33 for disposing the first sprayer 31 and the second sprayer 32, in which the first sprayer 31 is in a downward inclined state and the second sprayer 32 is in an upward inclined state. Accordingly, the color paint applied from the upper position and by the first sprayer 31 is sprayed onto the base layer 13 along a first spray direction SD1 that is inclined downward at a predetermined angle θ1 relative to the horizontal reference plane R. The predetermined angle θ1 is from 20 degrees to 30 degrees. The color paint applied from the lower position and by the second sprayer 32 is sprayed onto the base layer 13 along a second spray direction SD2 that is inclined upward at a predetermined angle θ2 relative to the horizontal reference plane R. The predetermined angle θ2 is from 20 degrees to 30 degrees. Therefore, the apparatus of the present disclosure has better economic benefits, and the exterior pattern P manufactured by the apparatus can be combined with the golf ball to provide a unique visual effect to people.

In practice, the color paints have a viscosity from 18 seconds to 22 seconds that is measured by a No. 4 Zahn cup and at a temperature from 24° C. to 25° C. The first sprayer 31 and the second sprayer 32 are each a pressure feed spray gun (model name: SGD-71/SGD-RA100/SGD-RA-200 available from Taiwan Prona Industries Co., Ltd.). Application conditions of the first sprayer 31 and the second sprayer 32 mainly include an atomization pressure of 1-3.5 $Kg/cm^2$. Furthermore, the first sprayer 31 has a first spraying head 311, and the second sprayer 32 has a second spraying head 321. The first sprayer 31 (or the second sprayer 32) can spray the color paint in fine dots, in messy filaments, or in a pear skin texture by using different kinds of the first spraying head 311 (or the second spraying head 321). It should be noted that, each of the first sprayer 31 and the second sprayer 32 has a self-cleaning function for removing residual color paint after being used for a period of time, thereby achieving a long-term normal and stable operation.

Based on the above application conditions, the first sprayer 31 is configured such that the shortest horizontal distance HD1 between the first spraying head 311 and the center point CP of the ball-shaped body 1 is from 10 cm to 25 cm, preferably from 12 cm to 20 cm, and that the shortest vertical distance VD1 between the first spraying head 311 and the horizontal reference plane R is from 4 cm to 10 cm, and preferably 6 cm. Similarly, the second sprayer 321 is configured such that the shortest horizontal distance HD2 between the second spraying head 321 and the center point CP of the ball-shaped body 1 is from 10 cm to 25 cm, preferably from 12 cm to 20 cm, and that the shortest vertical distance VD2 between the second spraying head 321 and the horizontal reference plane R is from 4 cm to 10 cm, and preferably 6 cm.

Figure 5:
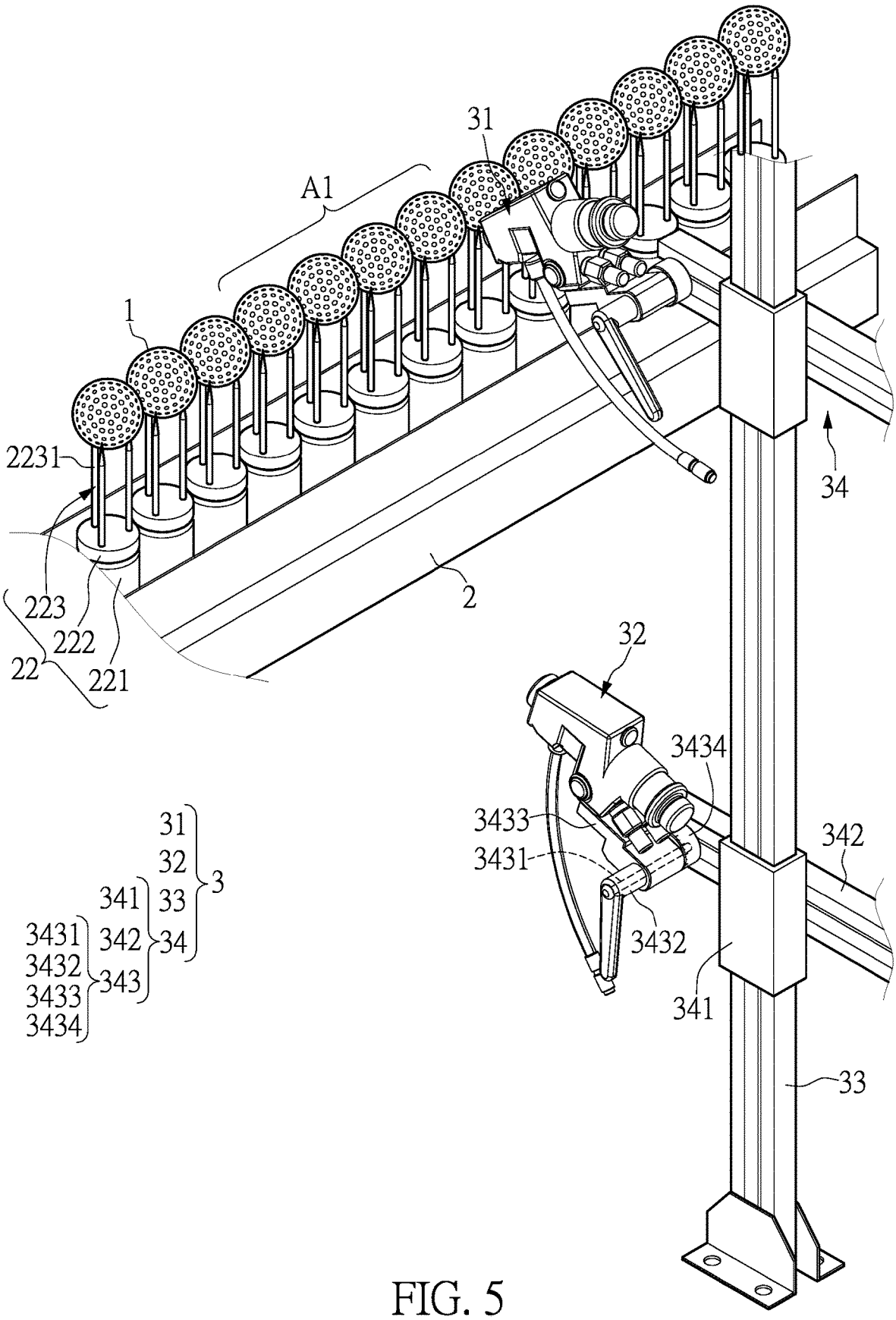
FIG. 5 is another partial perspective view of the apparatus according to the first embodiment of the present disclosure.

Reference is made to FIG. 5. In order to increase flexibility and convenience of operation, each of the first sprayer 31 and the second sprayer 32 can be fixedly connected to the support 33 by a position adjusting mechanism 34, and be adjusted in height (i.e., the shortest horizontal distance between the first or second spraying head and the horizontal reference plane) and spray angle (i.e., the inclination angle of the first or second spray direction) by the position adjusting mechanism 34. More specifically, the position adjusting mechanism 34 can include a sliding member 341 (e.g., a sliding block), a supporting arm 342 and an angle adjusting assembly 343. The sliding member 341 is rotatably disposed on the support 33 and can slide along a height direction of the support 33. The supporting arm 342 is fixedly connected to the sliding member 341. The angle adjusting assembly 343 is installed at one end of the supporting arm 342 for fixing the first sprayer 31 or the second sprayer 32 and adjusting its angle relative to the horizontal reference plane R.

In practice, the angle adjusting assembly 343 can include a pivot 3431, an adjusting rod 3432, a fixing seat 3433 and a dial indicator 3434. The pivot 3431 is fixedly connected to the one end of the supporting arm 342. The adjusting rod 3432 is pivoted on the pivot 3431. The fixing seat 3433 is integrated with the adjusting rod 3432. The dial indicator 3434 is disposed at one side of the fixing seat 3433. For example, the dial indicator 3434 is disposed around the adjusting rod 3432 and located at the one side of the fixing seat 3433.

In use, the first sprayer 31 or the second sprayer 32 can be immovably fixed to the fixing seat 3433, and the fixing seat 3433 can be rotated by the adjusting rod 3432 to align an alignment line thereon with a desired angle scale. According, the first sprayer 31 or the second sprayer 32 is in a specific inclined state. In addition, the first sprayer 31 or the second sprayer 32 can be moved to a specific height position by the corresponding sliding member 341. According to particular requirements (e.g., space constraint requirements), the first sprayer 31 and the second sprayer 32 can be staggered in a lateral position by rotating the sliding member (s) 341. A degree of freedom of movement and rotation of the sliding member(s) 341 can be restricted by fitting and fixing. The above description is only exemplary, and is not intended to limit the scope of the present disclosure.

Figure 2:
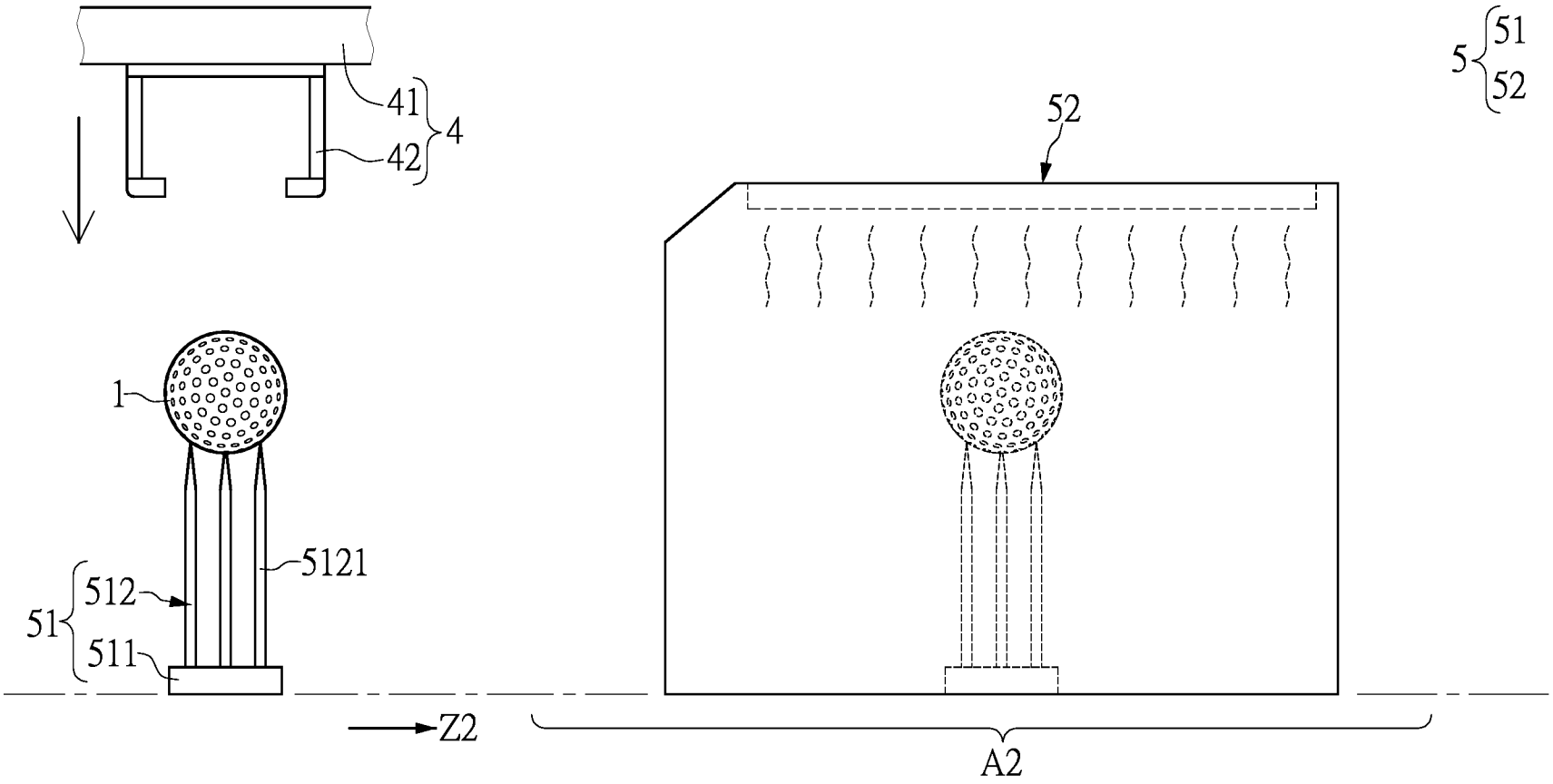
FIG. 2 is a planar view showing another manufacturing process of the apparatus according to the first embodiment of the present disclosure.

Reference is made to FIG. 2, which is to be read in conjunction with FIG. 1. The apparatus of the present disclosure can further include a transferring device 4 and a drying device 5. The drying device 5 is disposed in a second processing area A2 that is separated from the first processing area A1. In use, the transferring device 4 is configured to transfer the ball-shaped bodies 1 to the drying device 5 for drying the color paint(s) on the respective base layers 13.

In the present embodiment, the transferring device 4 includes a moving module 41 and at least one gripper 42 connected to the moving module 41. The moving module 41 is configured to reciprocally move between the first processing area A1 and the second processing area A2. The at least one gripper 42 is connected to the moving module 41, and it is configured to grip at least one of the ball-shaped bodies 1 and to move synchronously with the moving module 41. The drying device 5 includes a second conveyor 51 and a heater 52. The second conveyor 51 is configured to convey the ball-shaped bodies 1 to an effective heating range of the heater 52 to be dried. Accordingly, the exterior patterns are firmly adhered to the respective base layers 13.

In practice, the second conveyor 51 can include at least one moving base 511 that has at least one second retaining member 512 disposed thereon. The second retaining member 512 can include at least three pointed bodies 5121 extending from the moving base 511. In use, the moving base 511 is configured to move the ball-shaped bodies 1 along another predetermined path Z2. The at least one second retaining member 512 is configured to receive at least one of the ball-shaped bodies 1 from the at least one gripper 42, and to retain the at least one of the ball-shaped bodies 1 at a predetermined height, so as to enter the effective heating range of the heater 52. The above description is only exemplary, and is not intended to limit the scope of the present disclosure.

Second Embodiment

Figure 11:
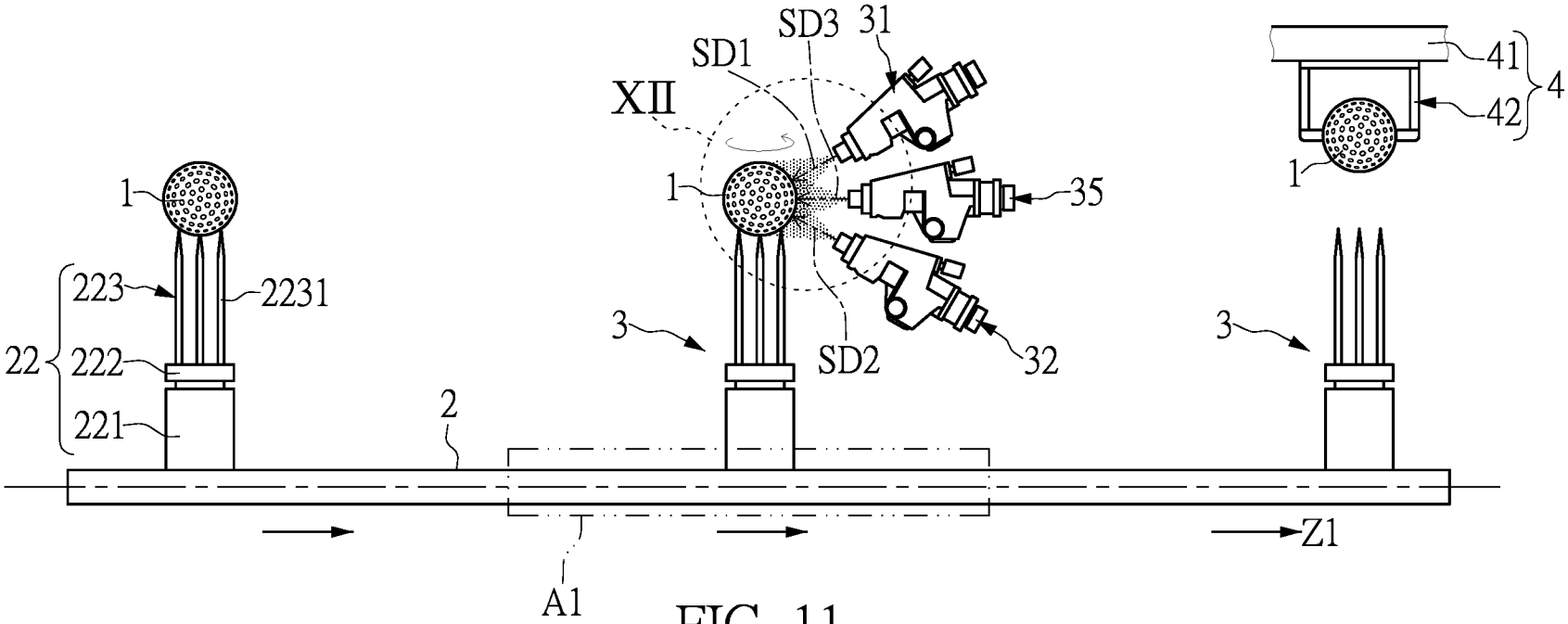
FIG. 11 is a planar view showing a manufacturing process of an apparatus for manufacturing golf balls each having an exterior pattern according to a second embodiment of the present disclosure.
Figure 12:
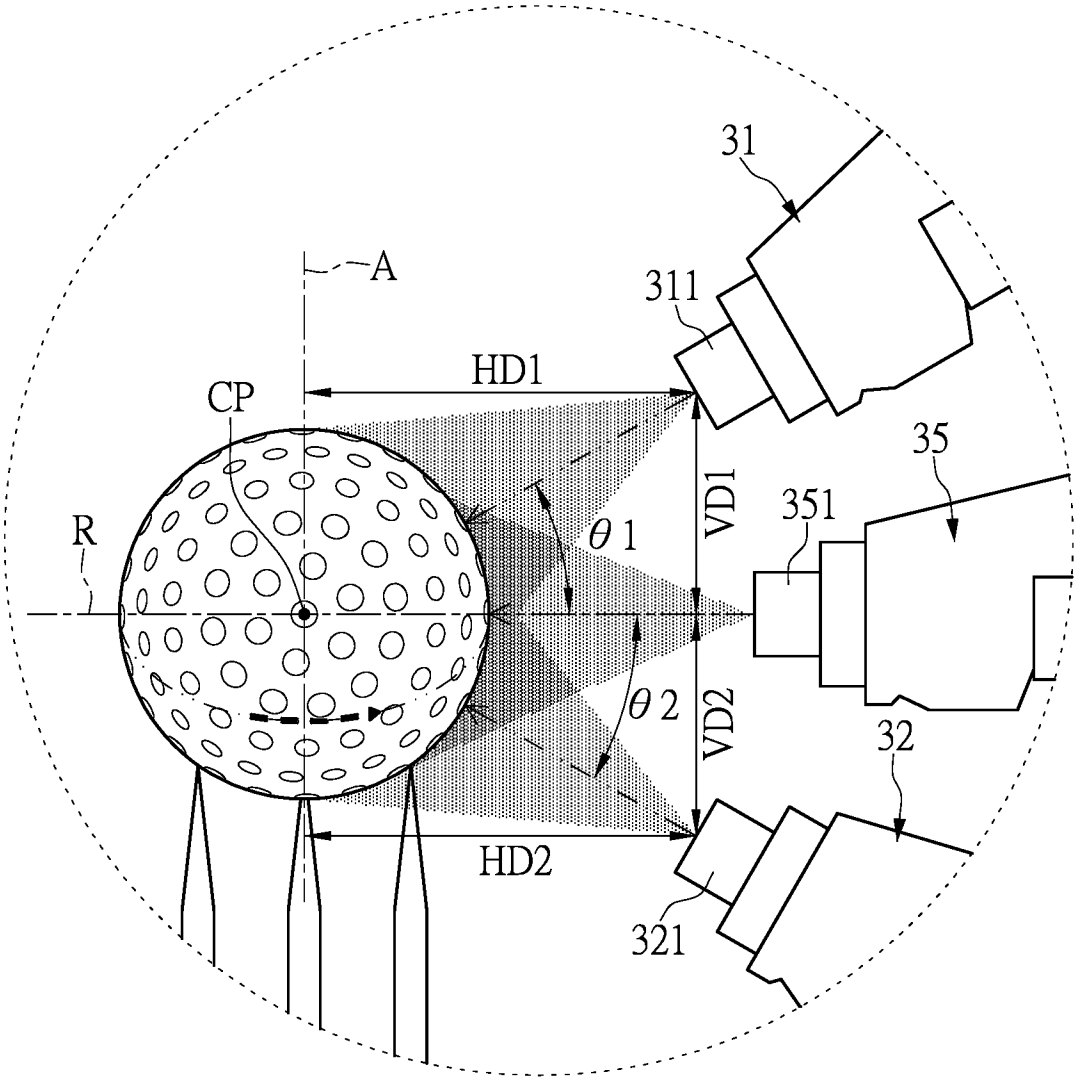
FIG. 12 is an enlarged view of part XII of FIG. 11.
Figure 13:
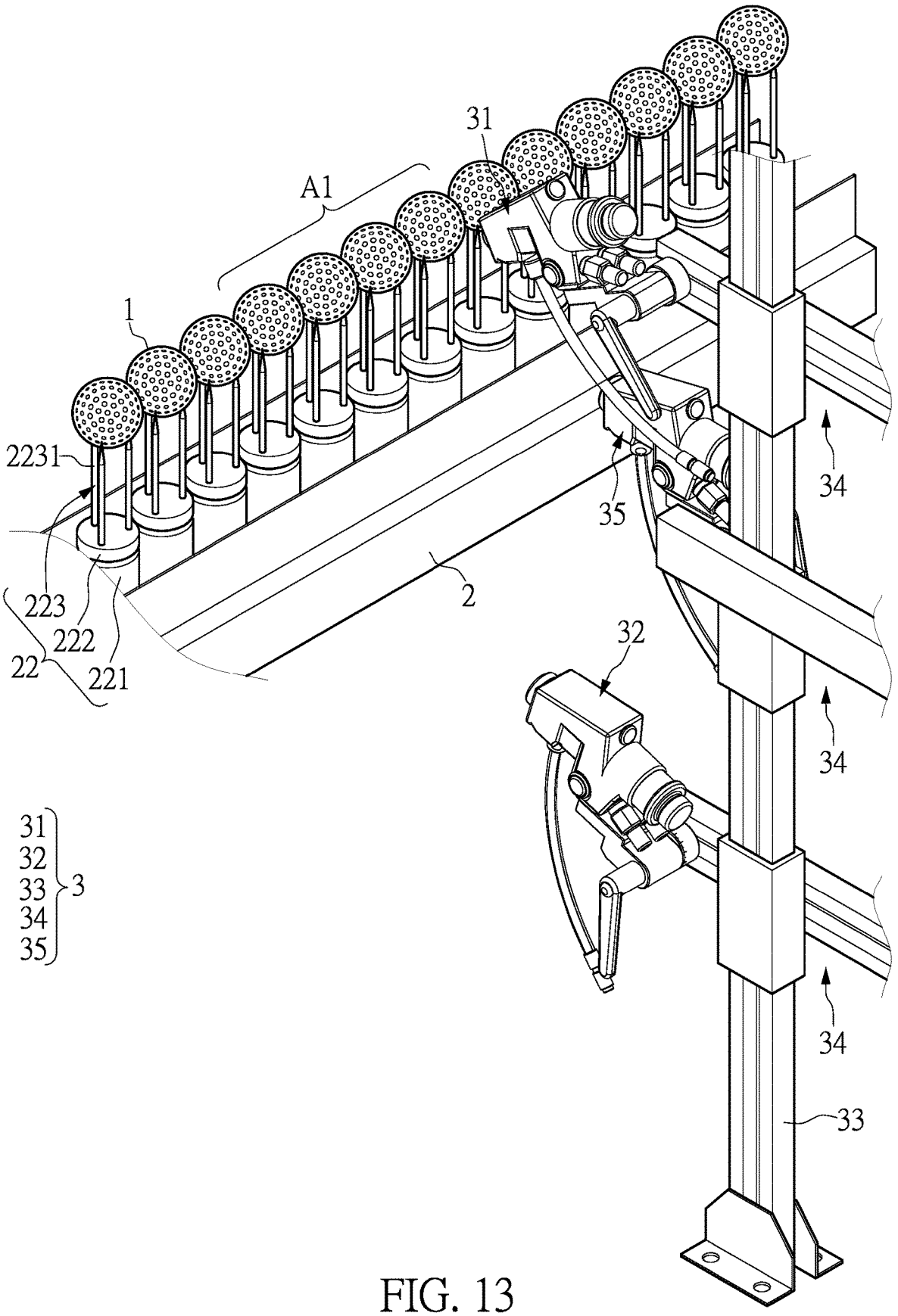
FIG. 13 is a partial perspective view of the apparatus according to the second embodiment of the present disclosure.

Referring to FIG. 11 to FIG. 13, which are to be read in conjunction with FIG. 2 and FIG. 10, a second embodiment of the present disclosure provides an apparatus for manufacturing golf balls each having an exterior pattern, which mainly includes a conveying device 2 and a spraying device 3 and can further include a transferring device 4 and a drying device 5. The conveying device 2 is configured to convey one or more ball-shaped bodies 1 into a first processing area A1 along a predetermined path Z1, and to rotate the one or more ball-shaped bodies 1 in the first processing area A1 at a predetermined speed. The spraying device 3 is disposed at one side of the first processing area A1 to apply at least one kind of color paint to the one or more ball-shaped bodies 1 in the first processing area A1 by spraying. The drying device 5 is disposed in the second processing area A2 for drying the one or more ball-shaped bodies 1. The second processing area A2 is separated from the first processing area A1. The transferring device 4 is configured to transport the one or more ball-shaped bodies 1 into an effective heating range of a heater 52. The technical details of the conveying device 2, the spraying device 3, the transferring device 4 and the drying device 5 are described in the first embodiment, and will not be reiterated herein.

The main difference of the present embodiment from the first embodiment is that the spraying device 3 includes a first sprayer 31, a second sprayer 32 and a third sprayer 35, which are configured to apply three color paints of different colors from an upper position, a lower position and a middle position to the one or more ball-shaped bodies 1 in the first processing area A1, respectively. The upper position is an upper diagonal position of the one or more ball-shaped bodies 1. The lower position is a lower diagonal position of the one or more ball-shaped bodies 1. The middle position is located between the upper position and the lower position. Therefore, each of the ball-shaped bodies 1 can have a multi-layered pattern P3, as shown in FIG. 10, which includes an upper-layered pattern area P31, a lower-layered pattern area P32 and a mid-layered pattern area P33 located between the upper-layered pattern area P31 and the lower-layered pattern area P32. It should be noted that, the upper-layered pattern area P31, the lower-layered pattern area P32 and the mid-layered pattern area P33 are different in colors from one another, such that the appearance(s) of the one or more ball-shaped bodies 1 can have a fine layer-by-layer effect so as to produce a unique visual effect.

More specifically, the spraying device 3 can further include a support 33 for disposing the first sprayer 31, the second sprayer 32 and the third sprayer 35, in which the first sprayer 31 is in a downward inclined state and the second sprayer 32 is in an upward inclined state. The third sprayer 35 can be in a slightly downward inclined state, a slightly upward inclined state or a horizontal state, and preferably in a horizontal state. In use, the color paint applied from the upper position and by the first sprayer 31 is sprayed onto the base layer 13 along a first spray direction SD1 that is inclined downward at a predetermined angle θ1 relative to the horizontal reference plane R. The predetermined angle 1 is from 20 degrees to 30 degrees. The color paint applied from the lower position and by the second sprayer 32 is sprayed onto the base layer 13 along a second spray direction SD2 that is inclined upward at a predetermined angle θ2 relative to the horizontal reference plane R. The predetermined angle θ2 is from 20 degrees to 30 degrees. The color paint applied from the middle position and by the third sprayer 35 is sprayed onto the base layer 13 along a third spray direction SD3 that is substantially parallel to the horizontal reference plane R. In order to improve a uniformity and fineness of the exterior pattern, the first sprayer 31 and the second sprayer 32 can be symmetrically arranged at upper and lower sides of a horizontal reference plane R that passes through at least one center point CP of the one or more ball-shaped bodies 1, and the third sprayer 35 can be disposed at one side of the one or more ball-shaped bodies 1 and corresponds in position to the horizontal reference plane R. Each of the ball-shaped bodies 1 in the first processing area A1 is divided into an upper half portion and a lower half portion by the horizontal reference plane R.

In practice, the color paints have a viscosity from 18 seconds to 22 seconds that is measured by a No. 4 Zahn cup and at a temperature from 24° C. to 25° C. The first sprayer 31, the second sprayer 32 and the third sprayer 35 are each a pressure feed spray gun (model name: SGD-71/SGD-RA100/SGD-RA-200 available from Taiwan Prona Industries Co., Ltd.). Application conditions of the first sprayer 31, the second sprayer 32 and the third sprayer 35 mainly include an atomization pressure of 1-3.5 $Kg/cm^2$. Furthermore, the first sprayer 31 has a first spraying head 311, the second sprayer 32 has a second spraying head 321, and the third sprayer 35 has a third spraying head 351. The first sprayer 31 (or the second sprayer 32/the third sprayer 35) can spray the color paint in fine dots, in messy filaments, or in a pear skin texture by using different kinds of the first spraying head 311 (or the second spraying head 321/the third spraying head 351). It should be noted that, each of the first sprayer 31, the second sprayer 32 and the third sprayer 35 has a self-cleaning function for removing residual color paint after being used for a period of time, thereby achieving a long-term normal and stable operation.

Based on the above application conditions, the shortest horizontal distance HD1 between the first spraying head 311 and the center point CP of the ball-shaped body 1 is from 10 cm to 25 cm, preferably from 12 cm to 20 cm, and the shortest vertical distance VD1 between the first spraying head 311 and the horizontal reference plane R is from 4 cm to 10 cm, and preferably 6 cm. Similarly, the shortest horizontal distance HD2 between the second spraying head 321 and the center point CP of the ball-shaped body 1 is from 10 cm to 25 cm, preferably from 12 cm to 20 cm, and the shortest vertical distance VD2 between the second spraying head 321 and the horizontal reference plane R is from 4 cm to 10 cm, and preferably 6 cm.

In order to increase flexibility and convenience of operation, each of the first sprayer 31, the second sprayer 32 and the third sprayer 35 can be fixedly connected to the support 33 by a position adjusting mechanism 34, and be adjusted in height (i.e., the shortest horizontal distance between the first, second or third spraying head and the horizontal reference plane) and spray angle (i.e., the inclination angle of the first, second or third spray direction) by the position adjusting mechanism 34. The technical details of the position adjusting mechanism 34 are described in the first embodiment, and will not be reiterated herein.

Beneficial Effects of the Embodiments

The apparatus for manufacturing golf balls each having an exterior pattern of the present disclosure can allow the golf balls to have an appealing appearance showing a unique visual effect during its service life, by virtue of "each of the rotatable retainers of the conveying device is configured to retain a ball-shaped body, and rotate the ball-shaped body being in the first processing area at a predetermined speed, and the first sprayer and the second sprayer of the spraying device are configured to apply two color paints from an upper position and a lower position to the ball-shaped body being in the first processing area, respectively".

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An apparatus for manufacturing golf balls each having an exterior pattern, comprising:

a conveying device including a first conveyor and a plurality of rotatable retainers, wherein the first conveyor is configured to sequentially convey the rotatable retainers into a first processing area, and each of the rotatable retainers is configured to retain a ball-shaped body, and rotate the ball-shaped body being in the first processing area at a predetermined speed; and a spraying device disposed at one side of the first processing area and including a first sprayer, a second sprayer, and a support for disposing the first sprayer and the second sprayer, the first sprayer being in a downward inclined state, and the second sprayer being in an upward inclined state;

wherein the first sprayer and the second sprayer are configured to apply a color paint to the ball-shaped body being in the first processing area from each of an upper position and a lower position, so as to allow the ball-shaped body to have the exterior pattern;

wherein the first sprayer and the second sprayer are symmetrically arranged at an upper side and a lower side of a horizontal reference plane that is configured to divide the ball-shaped body being in the first processing area into an upper half portion and a lower half portion; the upper position is an upper diagonal position of the ball-shaped body, and the lower position is a lower diagonal position of the ball-shaped body;

wherein each of the first sprayer and the second sprayer is fixedly connected to the support by a position adjusting mechanism that includes a sliding member, a supporting arm, and an angle adjusting assembly, the sliding member is slidably disposed on the support, the supporting arm is fixedly connected to the sliding member, and the angle adjusting assembly is installed at one end of the supporting arm for fixing the first sprayer or the second sprayer and adjusting its angle relative to the horizontal reference plane;

wherein the angle adjusting assembly includes a pivot, an adjusting rod, a fixing seat, and a dial indicator, the pivot is fixedly connected to the one end of the supporting arm, the adjusting rod is pivoted on the pivot, the fixing seat is integrated with the adjusting rod, and the dial indicator is disposed at one side of the fixing seat.

2. The apparatus according to claim 1, wherein the color paint applied from the first sprayer is sprayed onto the ball-shaped body along a first spray direction that is inclined downward at an angle from 20 degrees to 30 degrees relative to the horizontal reference plane, and the color paint applied from the second sprayer is sprayed onto the ball-shaped body along a second spray direction that is inclined upward at an angle from 20 degrees to 30 degrees relative to the horizontal reference plane.

3. The apparatus according to claim 1, wherein the first conveyor is a belt conveyor that is arranged to be parallel to a ground plane.

4. The apparatus according to claim 1, wherein each of the rotatable retainers includes a driving assembly, a supporting platform disposed on the driving assembly and arranged to be parallel to the first conveyor, and a first retaining member disposed on the supporting platform.

5. The apparatus according to claim 1, further comprising a drying device and a transferring device, the drying device disposed in a second processing area that is separated from the first processing area, the transferring device configured to transfer a predetermined number of the ball-shaped bodies each having the exterior pattern to the drying device.

6. The apparatus according to claim 5, wherein the transferring device includes a moving module and a plurality of grippers connected to the moving module, the moving module is configured to reciprocally move between the first processing area and the second processing area, and each of the grippers is configured to grip the corresponding one of the ball-shaped bodies each having the exterior pattern and to move synchronously with the moving module.

7. The apparatus according to claim 6, wherein the drying device includes a second conveyor and a heater, the second conveyor is configured to convey the predetermined number of the ball-shaped bodies each having the exterior pattern to an effective heating range of the heater.

8. The apparatus according to claim 7, wherein the second conveyor includes at least one moving base having at least one second retaining member disposed thereon.

* * * * *